United States Patent [19]

Rademacher

[11] Patent Number: 4,859,510

[45] Date of Patent: Aug. 22, 1989

[54] ARTIFICIAL VEGATATION OR PLANTS OR PARTS FOR THE SAME

[76] Inventor: Albert Rademacher, Am Glockenbach 11, D-8000 Munich 5, Fed. Rep. of Germany

[21] Appl. No.: 114,851

[22] Filed: Oct. 30, 1987

[30] Foreign Application Priority Data

Nov. 28, 1986 [DE] Fed. Rep. of Germany ..... 3640654

[51] Int. Cl.[4] ..... A41G 1/00

[52] U.S. Cl. ..... 428/17; 428/18

[58] Field of Search ..... 428/17, 18, 21

[56] References Cited

U.S. PATENT DOCUMENTS

| | | | |
|---|---|---|---|
| 1,511,588 | 10/1924 | Bleecker | 428/18 X |
| 1,949,063 | 2/1934 | Merrill | 428/17 X |
| 1,992,676 | 2/1935 | Schwarz | 428/90 X |
| 2,351,142 | 6/1944 | Mitchell | 428/919 X |
| 2,716,828 | 9/1955 | Adler, Jr. | 428/21 X |
| 2,811,906 | 11/1957 | Chappell | 428/28 X |
| 2,977,864 | 4/1961 | Pullar | 428/403 X |
| 3,554,848 | 1/1971 | Dock | 428/15 |
| 3,560,315 | 2/1971 | Evans et al. | 428/50 |
| 4,202,922 | 5/1980 | Osment | 428/18 |

FOREIGN PATENT DOCUMENTS 2902185 7/1979 Fed. Rep. of Germany .

OTHER PUBLICATIONS

Page 1520 and the Title Page of Webster's Third New International Dictionary G&C Merriam Company, Publishers Springfield, Mass., U.S.A.

*Primary Examiner*—Henry F. Epstein
*Attorney, Agent, or Firm*—Marshall & Melhorn

[57] ABSTRACT

A description is given of artificial vegatation or plants or parts for the same in the form of lawns or trees and branches covered with leaves or needles, or alternatively ice or snow. Such vegetation or plants are used in the design of landscape accessories for model railways, architectural models, trick and fairytale films and the like. The plants for the green areas or the leaves of the foliage are fixed by gluing with a regular or irregular density distribution to a net-like fibrous union, which is firmly or removably placed on the branches of a tree or bush, or on a large-area substrate. The leaves of a tree are advantageously formed from several fibrous union portions provided on the edges with cut open net meshes. It is important for this design that the foliage is shaped from suitable flat material in symmetrically repeating manner so as to simulate the natural shapes of foliage.

7 Claims, 8 Drawing Sheets

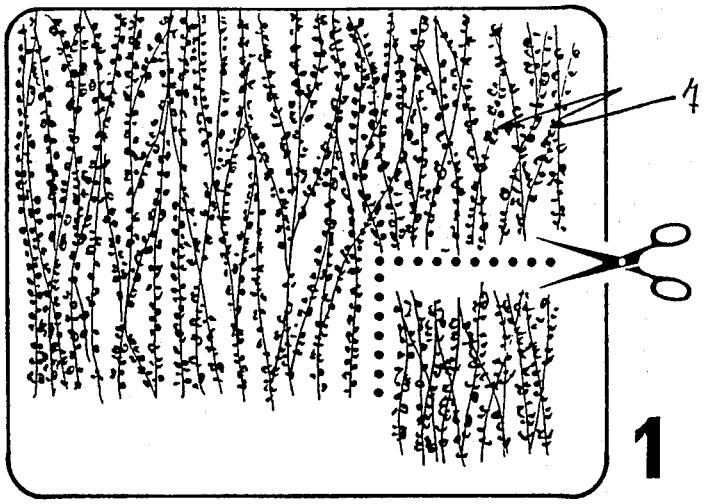
1
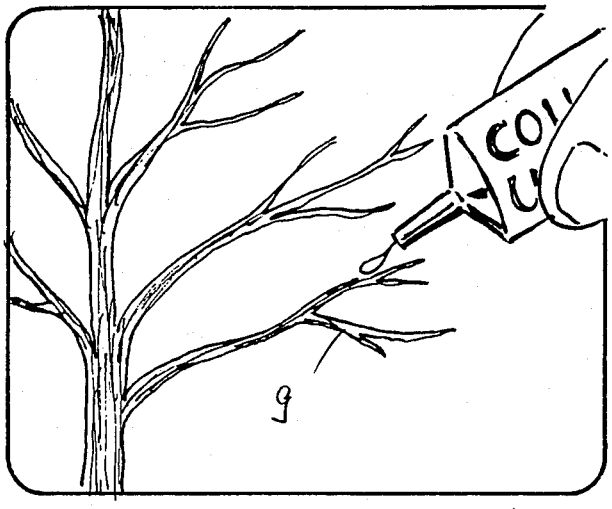
2
Fig 4
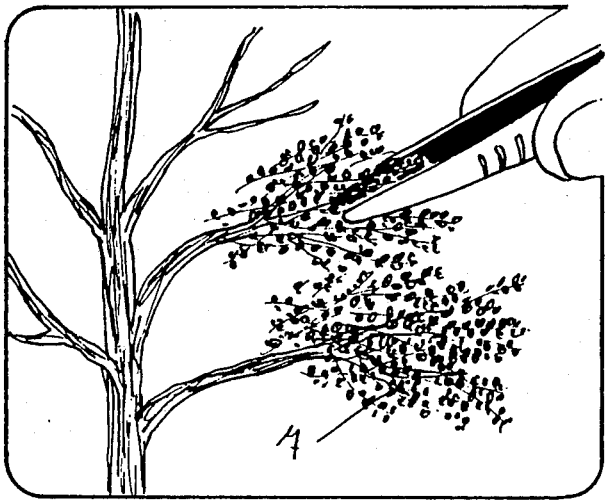
3

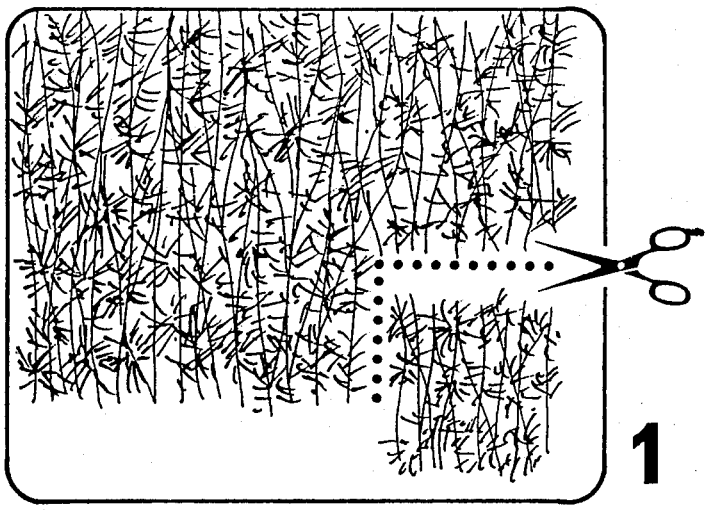
1
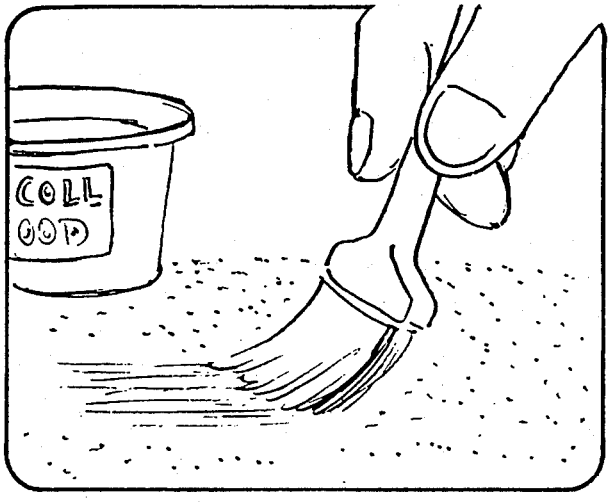
Fig. 8
2
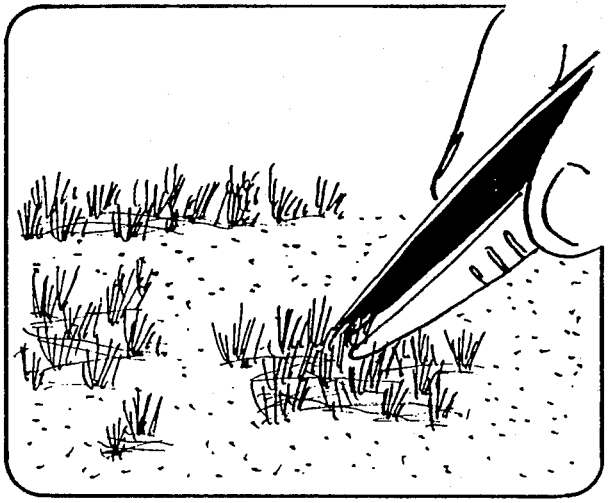
3

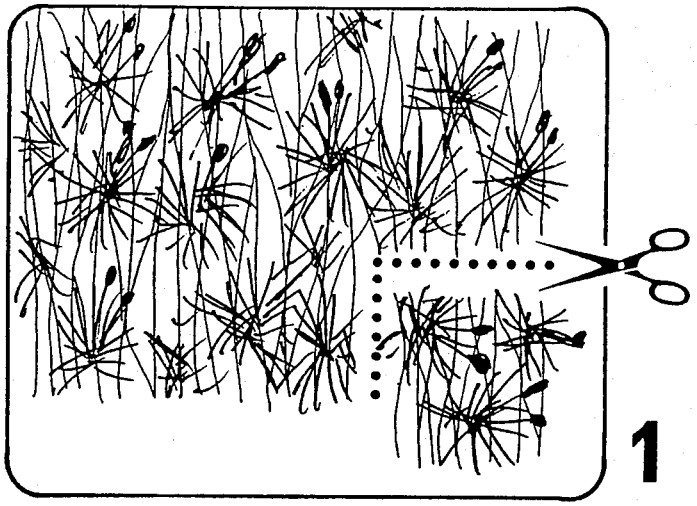
1
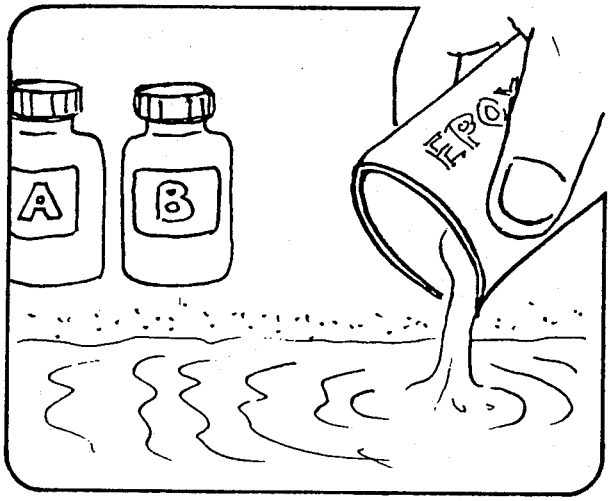
Fig 9
2
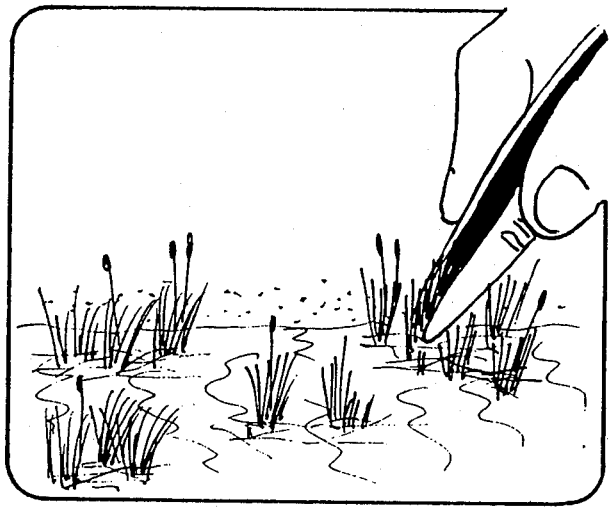
3

ARTIFICIAL VEGATATION OR PLANTS OR PARTS FOR THE SAME

DESCRIPTION

The invention relates to artificial vegetation or plants or parts for the same.

The present artificial plants, trees or bushes of all types, grasses and the like are used in sizes of a few centimetres up to a few declaimers e.g. for model landscapes. In a large number of different forms and with different quality requirements, they are used for making more attractive architectural models, the landscape design of model railways and are of interest in setting up trick exposures. Enthusiasts in part individually design and construct them to produce landscapes which are as natural as possible, whereas in industry they are mechanically produced and marketed.

Modellers, who in the past have produced such artificial plants and the like with great care at home, have of late seen a large number of also industrially produced designs and the range of choice is increasing in accordance with the increase in leisure activities.

The industrial or at least partially industrial production of such plants, bushes, lawn models and trees of all types generally comprises a support structure, such as the trunk of a tree with corresponding branches, is generally produced by a continuous moulding process. Using this moulding or casting process, it is possible to process both suitable plastics and metals or metal alloys. Cast, injection moulded and also wire-made structures or the foliage are inserted with pins into a base plate, on which the corresponding landscape is to be built up, mainly being fixed by plugging in or by bonding.

A significant difficulty has hitherto been to bring about a naturally appearing combination of the trunk or branches on the one hand and the simulated foliage for such a tree on the other. This has often only been possible in the past through using the assistance of appropriate artistically inclined workers.

DE-OS No. 29 02 185 discloses making the foliage from a non-metallic, transparent, tangled fibre-like carrier material, in that an adhesive is applied to the non-woven fabric or fibrous fleece and then the carrier material is at least partly covered with a non ferrous material simulating the leaves and formed from foam particles or some other granular material (e.g. sawdust), after which a durable joint is produced by adhesion and said joint can also be guaranteed during transportation.

However, the coating of the cast or injection moulded tree trunk forming the support structure for such foliage with such a thin-layer tangled fibre fleece material, as well as the application of foam material fragmented into scraps, pieces or particles to the tree branches has led to model shapes giving an unnatural overall impression, especially for the foliage, particularly in the case of the often desired and desirable intense illumination of the resulting landscapes. The diffuse scattering of the light on the hitherto used tangled fibre material or foam particles is the main reason why in the past it has not been satisfactorily possible to overcome these disadvantages.

In the case of green surfaces on the ground, such as lawns and the like, it is known to adhere the simulated plants to a plastic sheet. The simulation can be natural in the case of a dense covering, so that the sheet is completely covered with green. However, as soon as the green covering is broken up, it is difficult to conceal the unnatural impression brought about by the transparent sheet.

The problem of the present invention is to so improve artificial vegetation or plants or parts for the same of the aforementioned type that the optical overall impression thereof is very close to the natural plants or vegetation simulated.

This problem is inventively solved by the characterizing features of the present invention.

The arrangement of a net or netting-like fibre union between the substrate for the vegetation and the latter, as well as between the carrier or support in the form of the branches of trees or bushes and the leaves or needles makes it possible to fix a large number of fragments simulating small plants or plant parts in a regular or irregular density variation, without said thread union appearing in a manner prejudicial to the natural appearance.

As a result of the fact that the leaves of the artificial plants produced, such as e.g. the leaves of the most varied tree species, but also snowflakes and the like can be made from a flat material, which can be given a very natural colouring, particularly in the case of leaves in their autumn shades and the particular leaf shape can be very naturally reproduced by punching from a flat material, there is a natural and realistic overall impression, e.g. for the model of a birch. It is advantageous in this connection that the leaves or similar foliage simulated as regards their circumferential contour are shaped in such a way that they are homologously repeated over at least one axis of symmetry, so that the position of the leaf in the overall impression is not noticed, even when changing the direction between the stalk attachment and leaf tips. It is also important that such foliage is not permanently connected to a thin, transparent layer and is instead bonded by means of an adhesive to a hairnet-like carrier material, which can be easily introduced over and into the branches in an optimum three-dimensional distribution and can therefore e.g. be distributed over the entire depth of a tree crown or top. The cut up meshes of the net, i.e. the resulting free ends of the meshes or threads of the net form together with the punched out leaves bonded thereto, a harmonious extension of the actual branches of a tree up to the tip of each branch extension. The leaves shaped from suitable flat materials and meeting the most varied requirements, such as e.g. multicoloured autumn colouring in optimum manner, reflect the light falling on them in a comparable manner to the light reflection on natural leaves of trees, bushes and the like. It is possible to completely avoid the hitherto occurring unnatural diffuse light distribution on the hitherto used particulate foam rubber foliages of artificial plants or also the thin layer, at least partially transparent fibrous fleece foliages and the resulting optical disadvantages.

Application and joining, which in practice can only be brought about by hooking the foliage material comprising a thread union and leaves glued thereto onto an artificial plant, particularly the branches of a tree, is very simple and requires no artistic skill, so that the amateur is encouraged through the plant selection supplied in a building set or the like, comprising units constituted by support structures (e.g. tree trunk and crown) and separately therefrom the foliage (plastic net plus adhering leaves) to carry out further individual designs and to make use of his own creativity.

As the individual branches or their free ends are harmoniously continued in a tree crown or the like through the cut open net meshes of the tree foliage, it is advantageous for the thread union carrying the foliage to be coloured in accordance with the branches. The meshing of the thread union net carrier glued with the leaves in non-homogeneous distribution, the self-modification thereof on the individual branches of the tree crown at differing distances from the trunk, the optically continuous extension of the branch ends through the cut open net meshes are brought about virtually automatically on joining the foliage net carrier on the one hand and the supporting tree crown on the other. The resulting overall impression is that each tree with foliage is individually produced, which can be scarcely expected with industrial manufacture.

It is very important in modern filming, e.g. when producing trick films or video clips, where working takes place with a high depth of focus at the lens setting, that the landscape built up from such tree and bush models are as similar as possible to natural landscapes, so that it is very advantageous to retain natural leaf forms in the overall impression. Surprisingly such a natural overall impression for the eye is brought about in optimum manner if the leaf form has at least one axis of symmetry, i.e. is symmetrically designed in either the longitudinal or transverse direction, but also in several axial directions, with respect to the edge contouring thereof.

BRIEF DESCRIPTION OF THE DRAWINGS

Further advantages and details can be gathered from the exemplified description of embodiments hereinafter, relative to the drawings, wherein show:

FIGS. 4.1–4.3 the application of leaves to a branch.

FIGS. 8.1–8.3 planting grass on the soil.

FIGS. 9.1–9.3 planting reeds.

Figure 1:
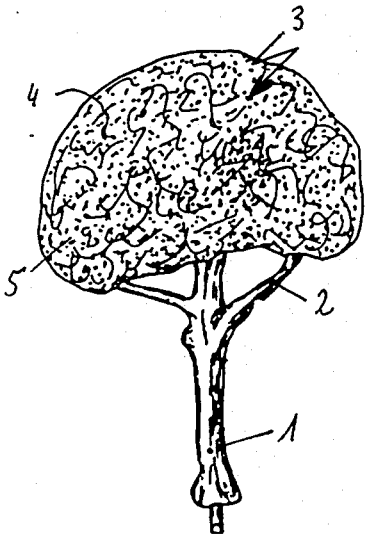
FIG. 1 an embodiment of an artificial tree according to the prior art.

The prior art model tree according to FIG. 1 is manufactured by a centrifugal casting process in a mould from cast metal as regards the trunk and branches. Independently of the manufacture of the tree structure, the tree foliage is produced from a nonferrous, transparent fibrous material cut into relatively large layers and coloured by spraying on both sides in order to provide the desired vegetation colour. Adhesive is then sprayed onto both sides of the covered fibrous fleece or similar transparent material and prior to the drying of the adhesive, a leaf-simulating material in the form of a foam or rubber-like material, but also of other particles, such as sawdust, is applied in such a way that the fibrous layer is at least partly covered. The thus produced laminated product serving as the foliage can then be sprayed with a varnish or lacquer, which again eliminates the adhesive characteristics necessary beforehand for the foliage. Finally the carrier material partly covered with leaf-simulating material is cut to a corresponding size for a tree structure or the like and is then drawn over the tree branches. In order to at least partly get away from the relatively unrealistic overall impression of the foliage shown in FIG. 1, it is known to break up the fleece or foam material into finer particles to permit the application and fixing thereof in three-dimensional distribution to the tree branches.

In the embodiment according to FIG. 1, the trunk 1 is made with a nonferrous metal casting, which also applies with regards to the branches 2, which serve as a support structure for the fibrous fleece 3 or a corresponding foam rubber layer or the like. Apart from its structure from staple fibres, the fibrous fleece 3 can also have a number of longer fibres, on or between which are joined foam rubber particles 5.

Figure 3B:
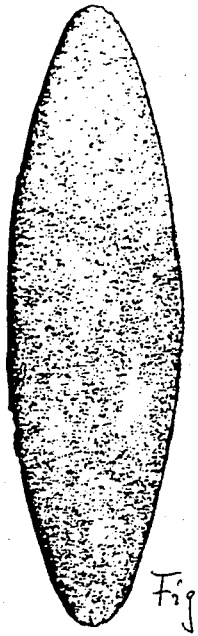
FIGS. 3*a*–3*e* symmetrically designed leaf forms or shapes for the foliage of a tree model according to FIG. 2.
Figure 3A:
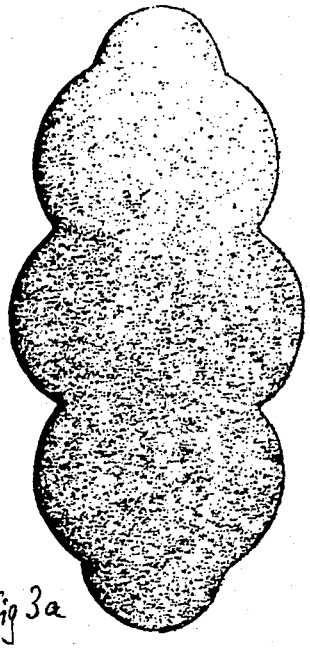
Figure 2:
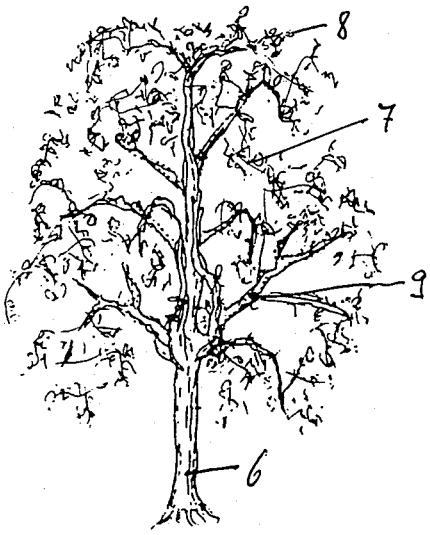
FIG. 2 an embodiment of a model tree according to the invention.

The inventively constructed tree model according to FIG. 2 also comprises a trunk 6, the branches 9 forming the crown or top of the tree and over said branches is suspended a preferably multipart net carrier in the form of a fibrou union, or is connected to the branches 9 in some other way. The fibrous union can have an irregular structure and is advantageously produced by unravelling a plastic rope. The fibrous union 7 forms the supporting structure for the foliage 8, which is shaped, e.g. punched from a flat material.

Figure 3C:
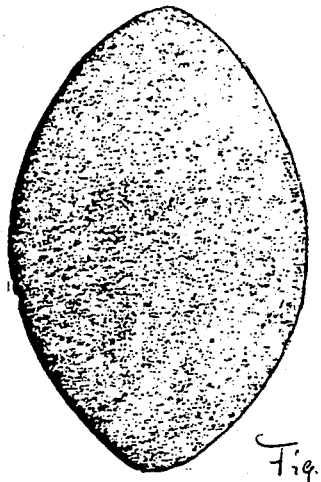
Figure 3D:
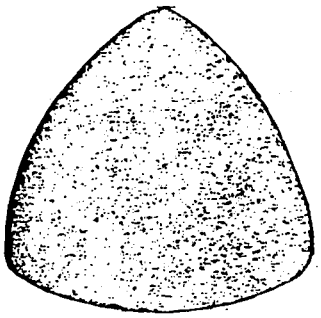
Figure 3E:
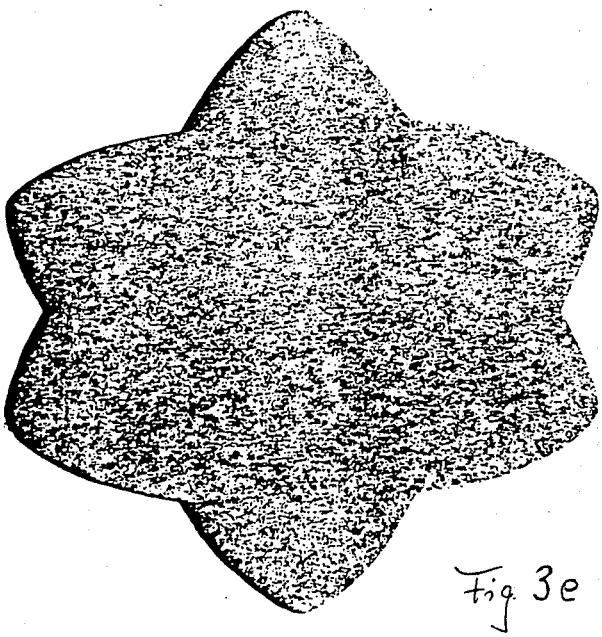

FIGS. 3*a*–3*e* show leaf forms produced according to the invention and it is easy to see that each of these leaf forms has several axes of symmetry, whereby in certain of these it is possible to see centrally mirror symmetrically positioned horizontal and vertical symmetry axes. FIGS. 3*d* and 3*e* have more than two axes of symmetry and within the scope of the invention it is possible to conceive further leaf forms based on this principle, ensuring that at least one of the symmetry axes and therefore half of the presently used leaf forms corresponds or is optically confusable with a specific foliage, such as e.g. that of an oak or birch tree.

The actual structure and manufacture of the trunk carrying the foliage and the crown, or a bush or the like are not of interest here. All that is significant is the nature and manner of constructing the foliage. As stated hereinbefore, use is made of a hairnet-like reticular carrier, whose mesh size is advantageously matched in optimum manner to the particular model. The net comprises a plastic fibrous union, e.g. comparable with a true hairnet, its colouring advantageously being chosen in such a way that it corresponds to that of the branches. Such a net is appropriately glued and to it are applied the leaves punched from a thin, flat material, so that a large number of leaves hangs on the net in a non-homogeneous density distribution and when the adhesive dries a permanent connection is obtained. In place of the punched out leaves according to FIGS. 3*a*–3*e*, it is obviously also possible for the representation of winter landscapes to use snowflakes or ice crystals for covering the vegetation. The foliage unit comprising the net carrier 7 and the leaf fragments 8, e.g. for the commercial sale of such model trees or similar plants can be separately packed in volume-favourable manner as a rolled up net strip or in layers of superimposed nets, or in already cut up form and can then be kept separately from the trees or bushes, or inserted in a building box. The joining of the fibrous union/foliage unit 7,8 on the one hand and the branches 9 on the other takes place after optionally cutting up the roller or layerwise fibrous union by hanging in the branches, each cut open net mesh automatically providing the end of a ramification of the tree crown. Emanating from the trunk, narrow, wide or random surface-cut nets with foliage adhering thereto can be inserted at random depths and heights of the branches and thus form a tree crown or bush foliage, which looks very similar to naturally occurring foliage.

In order to produce the needles of a conifer or the grass for a lawn, the fibrous union is uniformly or non-uniformly covered with glue and the simulated needles or grass are applied in known electrostatic manner to the fibrous union.

The above statements are illustrated in detail in FIGS. 4 to 9.

Thus, under 1 in FIG. 4 is shown a net-like fibrous union 7, which is formed from irregular net meshes, which in the represented manner contain irregularly distributed leaves or foliage. As shown, it is possible to cut from the fibrous union small surface units of random size which, as shown at 2 and 3 in FIG. 4, are loosely applied, e.g. by means of tweezers to the branches 9 which have been prepared with an adhesive.

Figure 5:
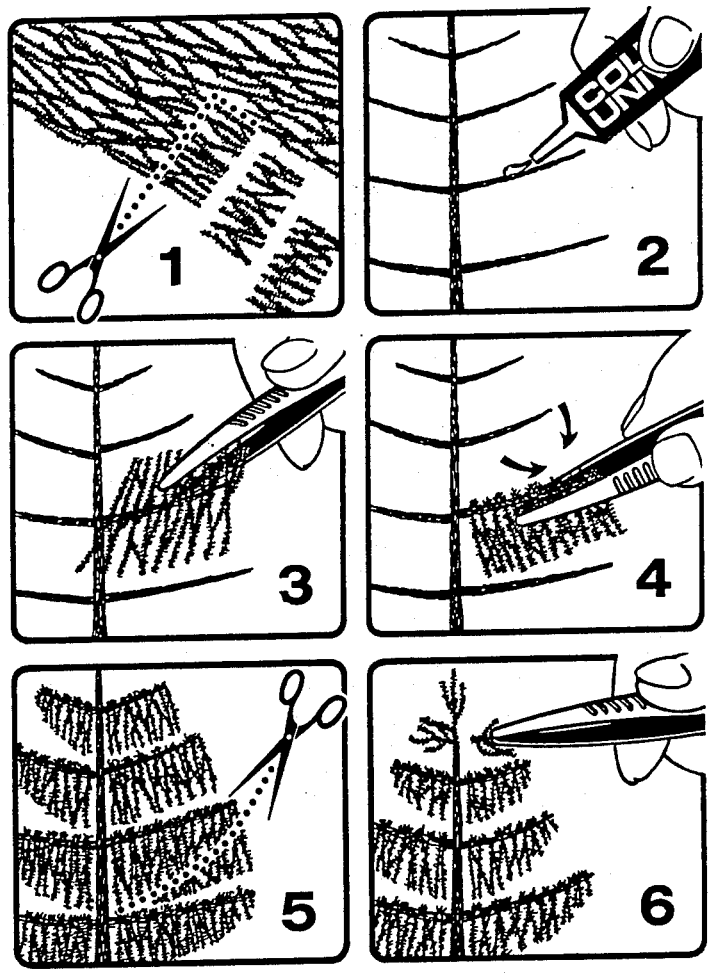
FIGS. 5.1–5.6 the application of needles to conifers.
Figure 6:
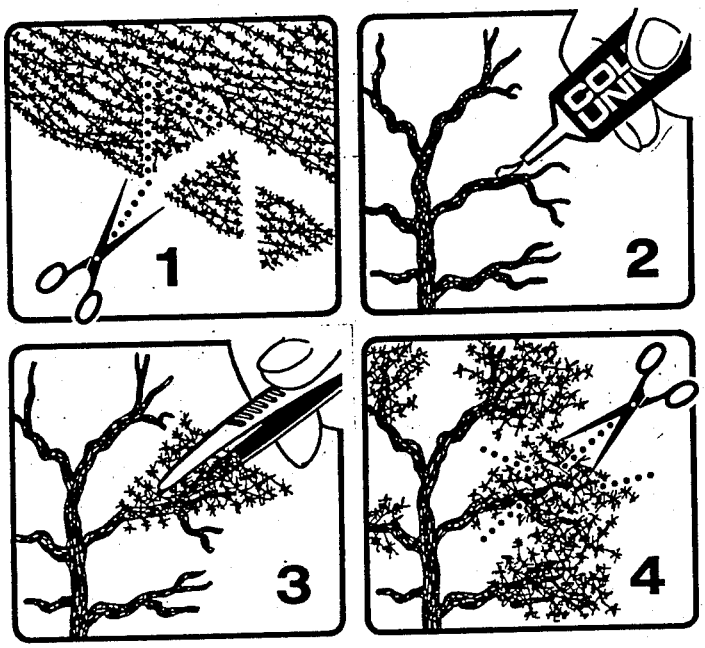
FIGS. 6.1–6.4 the application of needles to a gnarled pine.

FIG. 5 shows in 1 to 6 a comparable procedure, branches being given a green covering to form a conifer, whereby once again suitable surface portions are cut from the net-like fibrous union. Following application to the branch, they can undergo final processing by using scissors, if this is advantageous for the characteristic shaping, e.g. for a spruce. FIG. 6 shows a similar procedure for giving a green covering to a gnarled pine. It is advantageous in the manner shown to cut out triangular surface units from the original net-like fibrous union, which once again comprises a net with an irregular mesh distribution and to which needle-like particles are applied and as a result very characteristic needle effects are obtained for the pine.

Figure 7:
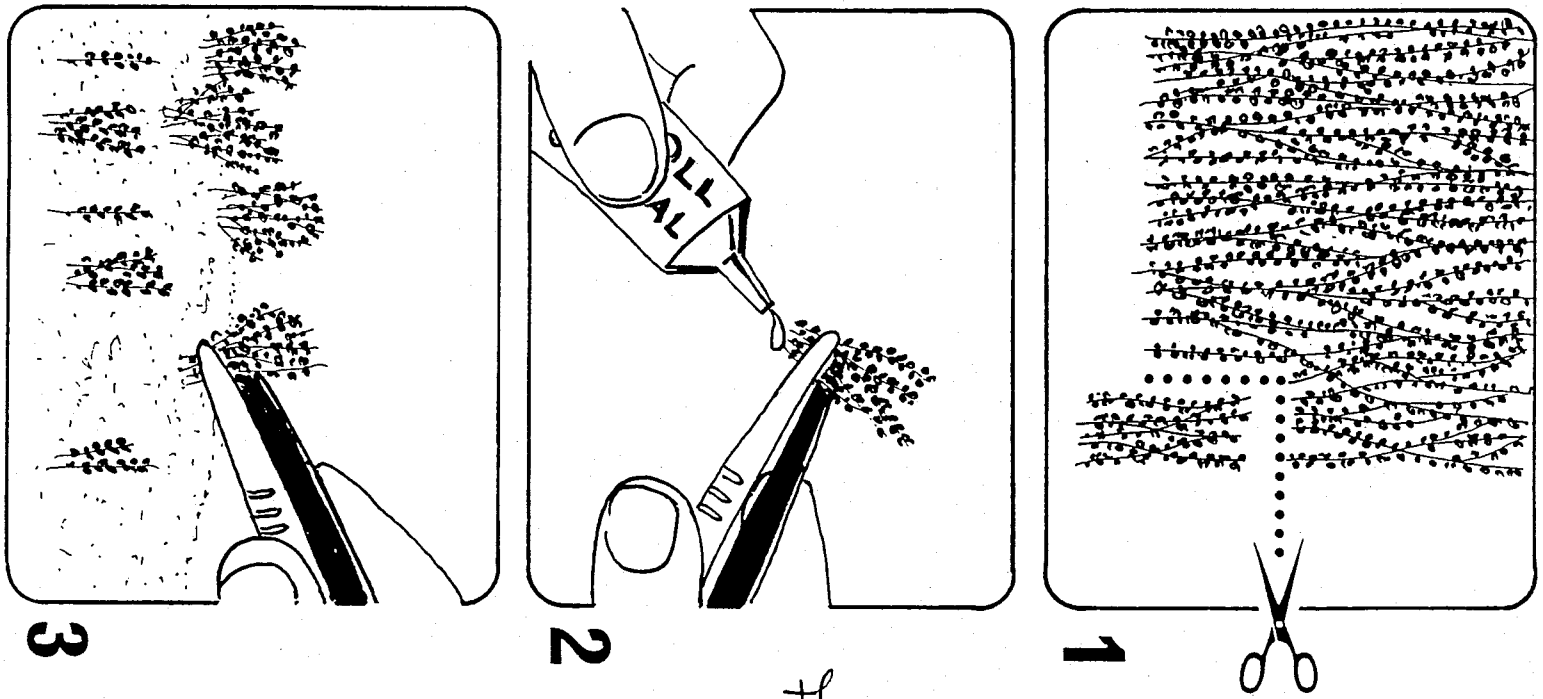
FIGS. 7.1–7.3 planting a surface with shrubs and flowers.

Finally, 1 to 3 in FIG. 7 illustrate the green covering of a ground or soil surface with plants, bushes and flowers of all types. Once again the starting object is a net-like fibrous union with leaves, needles, flower petals and the like, greening taking place in bundle-like manner using tweezers and adhesive.

FIG. 8 shows a surface green covering, in which the surface to be covered is initially pretreated with a glue and on this are then placed grass bundles, which are durably connected to the ground surface when the glue hardens.

FIG. 9 shows an example of covering with bundles of reeds. Once again the starting object is a fibrous union network, whereby a suitable surface area is provided with a casting resin, which simultaneously optically simulates the effect of a water surface in which, prior to hardening, portions are inserted from the fibrous union in bundle-like form using tweezers.

As is shown in the drawings, the action of the net-like fibrous union can be of a random manner and is suitable for imitating in a natural form any type of plant, such as moss and the like and a very individual and varying configuration of any landscape type is possible through cutting out specific surface shapes and sizes from the fibrous union.

I claim:

1. Artificial plants or parts of the same, comprising:

(A) a support structure designed to simulate the ground or bracnhes of a tree or bush;

(B) segments of a net-like fibrous material formed of predetermined sizes, said segments attached to said support structure in an irregular fashion over and throughout the depth of said support structure so as to appear as clusters of ground cover or natural extensions of the branches of a tree or bush;

(C) a plurality of particles of flat material of predetermined shapes of leaves, needles, snowflakes or ice crystals, said particles arranged throughout said segments of net-like fibrous material in an irregular density distribution; and (D) adhesive means for attaching said particles to individual fibers of said segments of net-like material.

2. Artificial plants or parts thereof according to claim 1, wherein said segments are cut open to simulate the natural extension of the leaf-covered branches of a tree.

3. Artificial plants or parts thereof according to claim 2, wherein the shapes of said particles have at least one axis of symmetry.

4. Artificial plants or parts thereof according to claim 3, wherein said particles are prepared from suitably colored material, so as to simulate the natural colors of leaves, needles, snowflakes, or ice crystals.

5. Artificial plants or parts thereof according to claim 4, wherein said segments are bonded to said support structure by adhesive means.

6. Artificial plants or parts thereof according to claim 4, wherein said segments are loosely hung from said support structure.

7. Artificial plants or parts thereof according to claim 1, wherein said segments are prepared from a plastic material.

* * * * *